US006739069B2

(12) United States Patent
Prajescu et al.

(10) Patent No.: US 6,739,069 B2
(45) Date of Patent: May 25, 2004

(54) COOL DOWN TEMPERATURE CONTROL SYSTEM FOR CLOTHES DRYER

(75) Inventors: Silvia Ionelia Prajescu, Dollard des Ormeaux (CA); Hugh Howard Hunt, Montreal (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 10/278,065

(22) Filed: Oct. 23, 2002

(65) Prior Publication Data

US 2003/0101617 A1 Jun. 5, 2003

(30) Foreign Application Priority Data

Nov. 30, 2001 (CA) ..... 2364067

(51) Int. Cl.[7] ..... F26B 19/01

(52) U.S. Cl. ..... 34/63; 34/66; 34/552; 34/543

(58) Field of Search ..... 34/552, 543, 546, 34/572, 62, 63, 66

(56) References Cited

U.S. PATENT DOCUMENTS 3,882,613 A * 5/1975 Wilson ..... 34/552
4,275,508 A * 6/1981 Jones ..... 34/524
4,397,101 A 8/1983 Rickard
5,101,575 A 4/1992 Bashark
5,187,879 A 2/1993 Holst
5,315,765 A 5/1994 Holst et al.
5,321,897 A 6/1994 Holst et al.
5,454,171 A * 10/1995 Ikeda et al. ..... 34/492
5,544,428 A 8/1996 Kuroda et al.
6,020,698 A 2/2000 Stenger et al.
6,047,486 A 4/2000 Reck et al.
6,199,300 B1 3/2001 Heater et al.
6,373,032 B1 * 4/2002 Bruntz et al. ..... 219/494

* cited by examiner

*Primary Examiner*—Ira S. Lazarus
*Assistant Examiner*—Kathryn S. O'Malley

(57) ABSTRACT

An automatic clothes dryer has a drying cycle followed by a cool down cycle where the cool down cycle is terminated when the sensed output temperature of the dryer drum falls below a default temperature value preselected or altered by user. This permits the user to adjust the termination cool down cycle temperature to the user's preference and touch sensitivity to the warmth of clothing removed from the dryer. The user adjusts the setting of a user variable selection device on the dryer control panel to a preferred temperature signal representing the desired temperature of articles in the dryer when the cool down cycle is terminated. The dryer has a comparator that is connected to the outlet thermistor for receiving the sensed signal representing the temperature of the air leaving the drum and that is connected to the user variable selection device for receiving the user preferred temperature signal. The comparator generates a cool down cycle termination signal to end the cool down cycle when the sensed signal favorably compares with the user preferred temperature signal. The comparator is preferably embodied in a microprocessor.

7 Claims, 2 Drawing Sheets

COOL DOWN TEMPERATURE CONTROL SYSTEM FOR CLOTHES DRYER

FIELD OF THE INVENTION

The present invention relates to an automatic clothes dryer having a cool down cycle and in particular relates to an operator preferential adjustment to the cool down cycle.

BACKGROUND OF THE INVENTION

In automatic clothes dryers it is common practice to have a user select a number of drying features such as, for example, permanent press, normal, fluff, and delicate that control the heat drying cycle of the clothing articles in the dryer and that also control the cool down cycle during which the clothes are allowed to cool down to a safe temperature for the operator to handle and remove articles from the dryer.

In more recent energy efficient clothes dryer controls, microprocessors responsive to thermistors sensing the dryer drum inlet temperature and/or dryer drum outlet temperature automatically control the drying cycle time and energy used depending on various algorithms programmed into the microprocessor and sensory inputs. In some instances the microprocessor calculates the cool down time period. In the cool down cycle, the drum continues to rotate and tumble the clothing and un-heated air is drawn or blown through the drum to cool the clothing. In automatic clothes dryers having a time dependent cool down cycle, the dryer operation is terminated when the time period of the cool down cycle elapses. Alternatively, a default temperature setting is used to terminate the cool down cycle. In this latter cool down control, the outlet thermistor in the cool down cycle continues to sense the dryer air outlet temperature and the microprocessor compares this sensed outlet temperature value with the default temperature setting. When the sensed outlet temperature value reaches the default temperature setting, the cool down cycle is completed.

While the feature of terminating the cool down cycle when the clothes reach a predetermined temperature, usually in the range of 100° F. to 120° F., depending on the cycle selection, works quite satisfactory, the user of clothes dryer may desire the clothing to be cooler or warmer to his or her touch when removing the clothes from the dryer drum. While this temperature touch sensation is subjective to each user, it is a feature currently not available in present clothes dryers.

SUMMARY OF THE INVENTION

It is an object of the present invention to provide a automatic clothes dryer having a cool down cycle where the user may adjust the termination cool down cycle temperature to the user's preference and touch sensitivity to the warmth of clothing removed from the dryer.

The present invention relates to an automatic clothes dryer having a drying cycle followed by a cool down cycle where the cool down cycle is terminated when the sensed output temperature of the dryer drum falls below a default temperature value preselected or altered by a user.

The present invention relates to an automatic clothes dryer having a drying cycle followed by a cool down cycle. The dryer has a clothes receiving rotatable drum, a blower for circulating air through the drum during the drying cycle and the cool down cycle, and a heater for heating air entering the drum during the drying cycle. The dryer further comprises an air exhaust path along which air is exhausted from the dryer drum and an outlet thermistor positioned in the air exhaust path generating a sensed signal representing the temperature of the air leaving the drum through the air exhaust path. The dryer further comprises a control circuit for terminating the cool down cycle. The control circuit comprises a user variable selection device that is set by the user to represent a user preferred temperature signal. The control circuit includes a comparator having first and second inputs and an output. The first input is connected to the outlet thermistor for receiving the sensed signal representing the temperature of the air leaving the drum. The second input is connected to the user variable selection device for receiving the user preferred temperature signal. The comparator generates at the output a cool down cycle termination signal to end the cool down cycle when the sensed signal favorably compares with the user preferred temperature signal.

The advantage with the present invention resides in the user variable selection device that permits the user to alter or change the value of the preferred temperature signal. That is the user can change the signal to have the clothing articles in the dryer drum either warmer or cooler when the cool down cycle is complete.

It should be understood that the improvement in the present invention relates to the advantageous feature of a user being able to modify the shut down of the dryer so that the heat sensation of the clothing to the user's touch is to the user's liking. This is accomplished by the user variable selection device that may be in the form of a rotary dial, a touch pad, or other suitable variable control switches on the control panel that indicate to a user a warmer or cooler final clothes temperature. The selection device permits the user to set the temperature signal within a range defined about a factory default temperature value, which preferably is ±5° F. about a default temperature of lying in the range of 100° F. to 120° F. depending on the cycle selection.

It should also be understood that the control circuitry may be a hard wire embodiment of the switches, relays and solenoids, or may be embodied in a microprocessor, or a combination thereof.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF PREFERRED EMBODIMENTS

Figure 1:
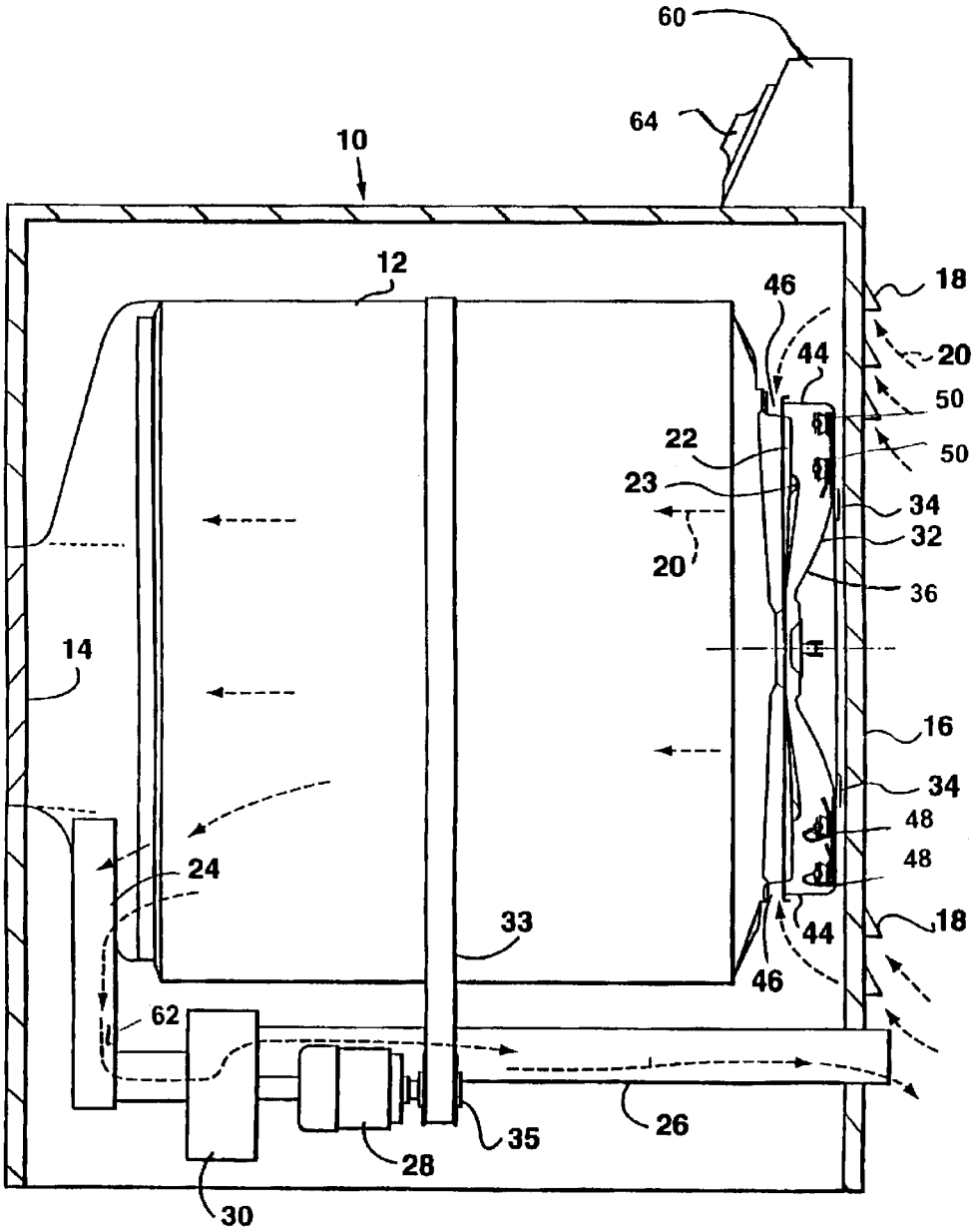
FIG. 1 is a side view of a clothes dryer having a thermistor placed at the outlet of the dryer drum; and, FIG. 2 is a schematic wiring diagram showing circuitry for the cool down temperature selection feature of the present invention.

Referring to FIG. 1 there is shown an electric clothes dryer 10 having a rotating drum 12 mounted therein. While the preferred embodiment is described with respect to an electrically heated clothes dryer, it should be understood that the clothes dryer may be heated by a gas burner. The rotating drum 12 has an open front through which access can be gained through door 14 of the dryer 10 for the insertion and removal of clothing and other articles from the drum. The clothes dryer 10 has a rear panel 16 provided with a series or plurality of louvers 18 through which air may be drawn into the interior of the dryer 10. The airflow is shown by arrows 20 passing through the louvers, through a series of openings 23 in the rear end head 22 of the dryer drum 12 through an exhaust air path comprising drum exhaust outlet 24 and exhaust ducting 26. Motor 28 draws or rotates blower or fan 30 to force the air 20 through the drum 12. The motor 28 through pulley 35 and belt 33 also causes the rotation of the dryer drum 12. The air flow path shown through the dryer drum 12 is an axial air flow in the preferred embodiment. Preferably, the drum 12 has a rotating rear end head 22. It should be understood that in alternate dryer constructions the rear end head 22 may be stationary and may include both an air inlet and an air outlet or exhaust port. Consequently the air flow thorough the dryer drum is not necessarily axial air flow. Further, the fan or blower 30 may be located in an air inlet pipe to push air into and through the dryer drum.

In FIG. 1, a heater housing 32 is mounted by suitable bolts 34 to the rear panel 16 of the dryer 10. The heater housing 32 is adjacent the end head 22. The heater housing 32 has a rear wall 36 that is spaced from the rear end head 22. The heater housing 32 has an upstanding sidewall 44 that extends around the periphery of the rear wall 36. The upstanding sidewalls 44 further extend towards the rear end head 22. An air gap 46 extends between the upstanding sidewall 44 and the end head 22 of the dryer drum. Air flows through the air input gap 46.

An electrically energized heater comprises helically wound heater coils 48 mounted via electrical insulators 50 to the rear wall 36 of the heater housing 32. The coils 48 are spaced from the rear walls 36 and from the end head 22 of the dryer drum. The heater coils 48 are connected to a source of electrical supply (not shown). When electrical energy is fed through terminals 52 to coils 48, the coils warm heating air passing over the coils and towards the openings 23 in the end head 22 of the dryer drum 12. It should be understood that electric heaters of differing construction may be employed in the dryer.

On top of the dryer 10 is a control panel 60 which includes control dials 64 or touch sensitive key pads for controlling the operation of the dryer 10. It should be understood that these dials 64 are utilized to provide for automatic control of the dryer 10 through a warm up cycle, one or more selected drying cycles and a cool down cycle. It is the cool down cycle control that the present invention is directed toward. In the cool down cycle the heater coils 48 are de-energized and the air circulating through the dryer begins to cool the internal temperatures within the dryer drum 12 and cool down the articles of clothing or other household fabrics within the drum. For the purposes of the present invention, a rotating dial 64 is shown on the top of the control panel 60 that is utilized as the user variable selection device that is set by the user to represent a user preferred temperature signal. Housed within the control panel 10 is a control panel board with control circuitry including a microprocessor 72 (see FIG. 2). The microprocessor 70 operates the dryer in accordance with signals supplied thereto by sensors located in the dryer 10. In the present invention, a thermistor sensor 62 is located in the exhaust air flow path in the duct 26 proximate the dryer exhaust drum outlet 24. The thermistor 62 generates a voltage signal that corresponds to the temperature of the air flow leaving the dryer drum and hence proportional to the temperature of articles tumbling in the dryer drum 12.

Figure 2:
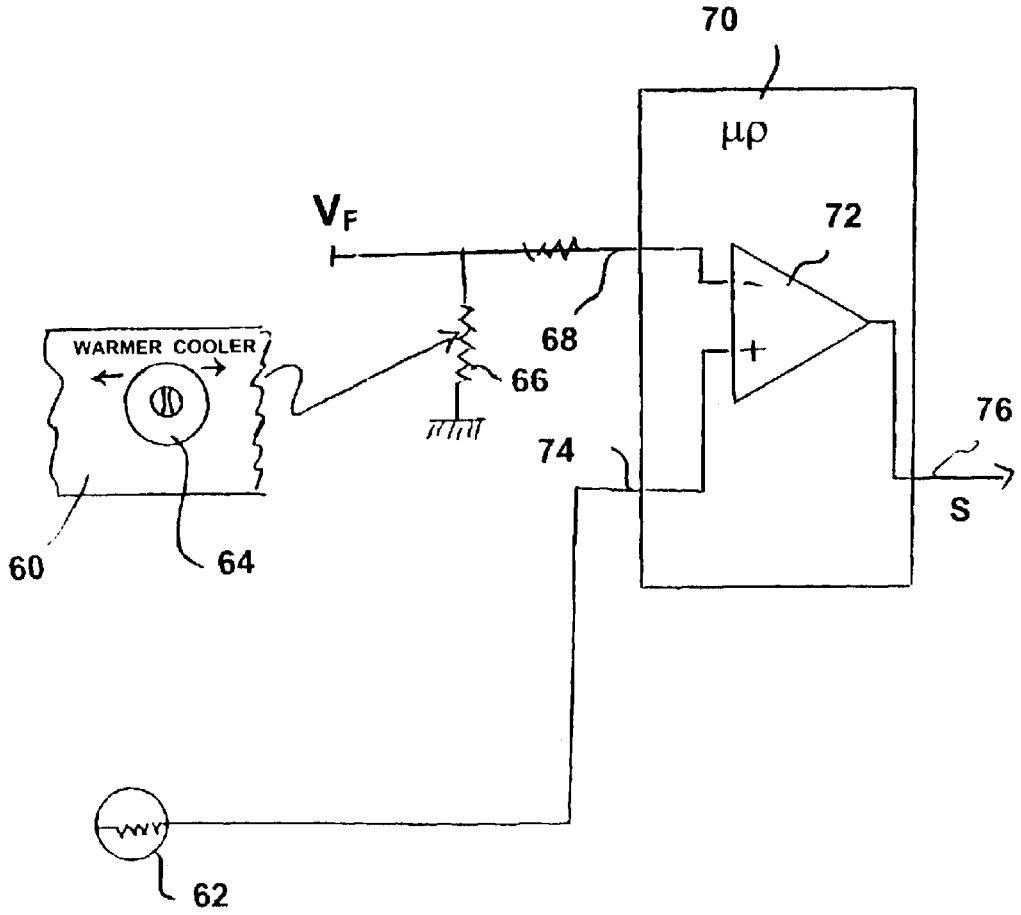

Referring to FIG. 2, a schematic representation of the control system of the present invention is shown. The control system comprises a control circuit for terminating the cool down cycle comprising a user variable selection device or dial 64 that is set by the user to represent a user preferred temperature signal. The variable selection switch is connected to a potentiometer 66. The dial 64 adjusts the voltage set by factory preset voltage $V_F$ to a preference voltage at input 68. The preferential voltage is representative of the preferential temperature chosen by a user selecting either a warmer or cooler setting on dial 64.

The input 68 is connected as one of many inputs (other inputs not shown) into a microprocessor 70. Embodied within the microprocessor 70 is a comparator 72. The comparator 72 has first and second inputs 74, 68 respectively and an output 76. The first input 74 is connected to the outlet thermistor 62 for receiving the sensed signal representing the temperature of the air leaving the drum 12. The second input 68 is connected to the factory present voltage $V_F$ as modified by potentiometer setting 66 which in turn is controlled by the user variable selection control dial 64. The comparator 72 generates at the output 76 a cool down cycle termination signal S to end the cool down cycle when the sensed signal from input 74 favorably compares with the user preferred temperature signal at input 68.

The user variable selection device permits the user to set the preferred temperature signal within a range defined about a factory default temperature value. In the preferred embodiment factory default temperature lies in a range of 100° F. to 120° F., depending on the drying cycle selected and the range is ±5° F.

As is apparent from the foregoing disclosure, various other embodiments and alterations and modifications which may differ from the embodiments disclosed may be readily apparent to a person skilled in the art. It should be understood that the scope of the patent shall be defined by the claims and those embodiments which come within the scope of the claims that follow.

What is claimed is:

1. An automatic clothes dryer having a drying cycle followed by a cool down cycle, comprising:

a clothes receiving rotatable drum;

a blower for circulating air through the drum during the drying cycle and the cool down cycle;

a heater for heating air entering the drum during the drying cycle;

an air exhaust path along which air is exhausted from the dryer drum;

an outlet thermistor positioned in the air exhaust path generating a sensed signal representing the temperature of the air leaving the drum through the air exhaust path; and, a control circuit for terminating the cool down cycle comprising:

a user variable selection device that is set by the user to a user preferred temperature signal representing a user desired temperature of clothes in the drum at the end of the cool down cycle; and, a comparator having first and second inputs and an output, the first input being connected to the outlet thermistor for receiving the sensed signal representing the temperature of the air leaving the drum, and the second input being connected to the user variable selection device for receiving the user preferred temperature signal, the comparator generating at the output a cool down cycle termination signal to end the cool down cycle when the sensed signal favorably compares with the user preferred temperature signal.

2. The automatic clothes dryer of claim 1 wherein the control circuitry includes a microprocessor.

3. The automatic clothes dryer of claim 2 wherein the comparator is embodied within the microprocessor.

4. The automatic clothes dryer of claim 1 wherein the user variable selection device comprises a variable selection switch located on a control panel for the clothes dryer.

5. The automatic clothes dryer of claim 4 wherein the variable selection switch is connected to a potentiometer.

6. The automatic clothes dryer of claim 1 wherein the user variable selection device permits the user to set the preferred temperature signal within a range defined about a factory default temperature value.

7. The automatic clothes dryer of claim 6 wherein the factory default temperature is between 100° F. and 120° F., depending on a selected drying cycle, and the range is ±5° F.

* * * * *